US006821307B2

(12) United States Patent
Caprotti et al.

(10) Patent No.: US 6,821,307 B2
(45) Date of Patent: Nov. 23, 2004

(54) OIL COMPOSITION

(75) Inventors: Rinaldo Caprotti, Oxford (GB); Christophe Ledeore, Ghent (BE)

(73) Assignee: Infineum International Ltd. (GB)

( * ) Notice: Subject to any disclaimer, the term of this patent is extended or adjusted under 35 U.S.C. 154(b) by 0 days.

(21) Appl. No.: 10/260,023

(22) Filed: Dec. 18, 2002

(65) Prior Publication Data

US 2003/0192233 A1 Oct. 16, 2003

Related U.S. Application Data

(63) Continuation of application No. 09/424,003, filed on Nov. 15, 1999, now abandoned.

(30) Foreign Application Priority Data

May 15, 1997 (GB) ..... 9709826

(51) Int. Cl.[7] ..... C10M 133/56

(52) U.S. Cl. ..... 44/347; 44/348

(58) Field of Search ..... 44/348, 347

(56) References Cited

U.S. PATENT DOCUMENTS 5,853,434 A * 12/1998 Harrison et al. ..... 44/331
6,146,431 A * 11/2000 Harrison et al. ..... 44/331

FOREIGN PATENT DOCUMENTS

WO WO 96/01854 * 1/1996

OTHER PUBLICATIONS

Wison, Bill "Fuel Lubricity" Industrial Lubrication and Tribology, vol. 48, #1, Jan.–Feb. 1996,pp. 10–14.*

* cited by examiner

*Primary Examiner*—Cephia D. Toomer

(57) ABSTRACT

An improved fuel oil composition comprises fuel oil and specific acylated polyalkylene polyamine.

8 Claims, 1 Drawing Sheet

Cummins L10 Results

Cummins L10 Results

OIL COMPOSITION

Figure 1:
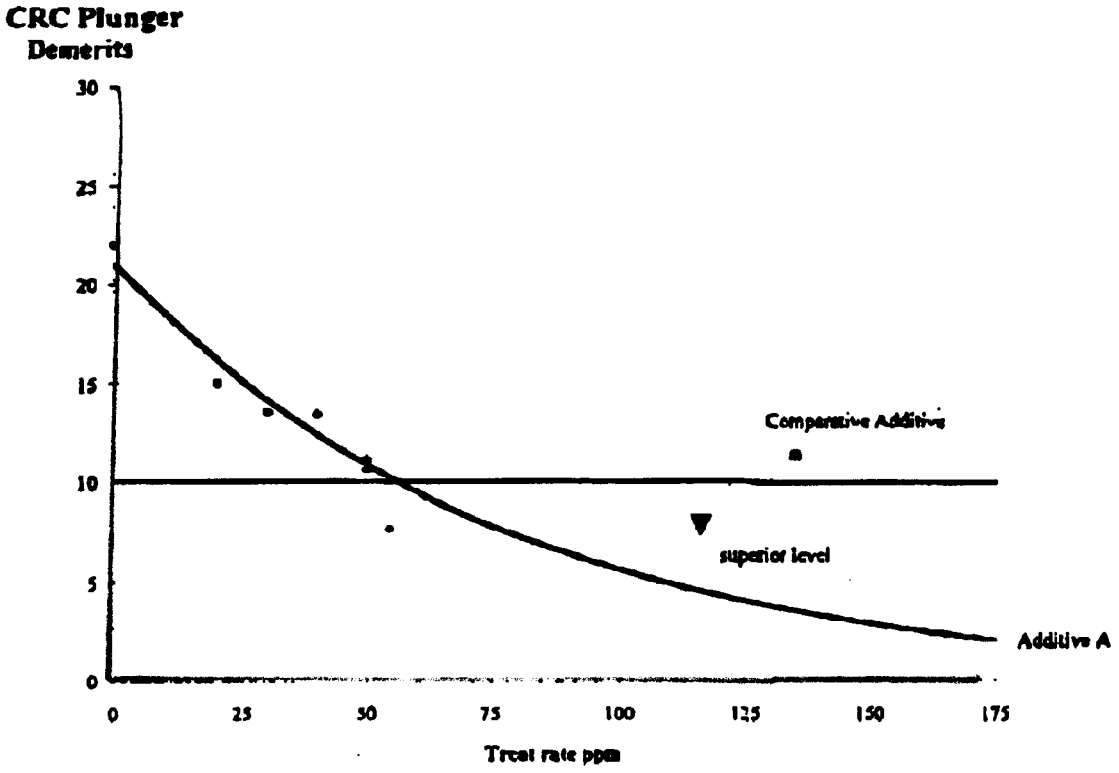

This application is a continuation of application Ser. No. 09/424,003, filed Nov. 15, 1999, now abandoned.

This invention relates to improved detergent and lubricity additives for fuel oils.

The art generally describes additives derived from hydrocarbyl-substituted succinic acylating agents (such as succinic anhydrides) and polyalkylene polyamines. These materials are sometimes known as 'succinimides' or 'acylated nitrogen dispersants' Particularly well-known are those materials wherein the succinic substituent is derived from polyisobutylene, the resulting materials being commonly known as 'PIBSA-PAM' (Polyisobutylene-succinic anhydride-polyamine) products.

The trivial name of 'succinimides' is, for many of these products, rather an oversimplification. The commercially-available materials used to make these products are typically complex mixtures rather than discrete compounds, and thus give rise to a complex mixture of other condensation products in addition to various imides.

EP-B-0 451 380 provides a broad general description of PIBSA-PAM products and illustrates the complex nature of many polyamine mixtures. The examples are restricted to PIBSA-PAM products obtained from polyethylene tetramine or pentamine at molar ratios of 1.5:1 or greater (PIBSA:PAM).

With such variability in products produced from different sources of starting materials, there exists in the art a continual need for better understanding of the molecular parameters controlling various aspects of additive performance, and for better-performing, more cost-effective products Surprisingly, it has now been found that by selecting a certain mole ratio of reactants and certain polyamine characteristics, products having improved go application specifically in fuel oils are obtained.

In a first aspect, the invention provides a fuel oil composition comprising a fuel oil and a minor proportion of an additive, wherein the additive comprises the product obtainable by the reaction between (i) a hydrocarbyl-substituted succinic acylating agent, wherein the hydrocarbyl substituent has a number-average molecular weight (Mn) of 250 to 2500, and (ii) one or more polyalkylene polyamines, characterised in that the polyamine component (ii) contains greater than 35% by weight of polyamines having more than six nitrogen atoms per molecule, based on the total weight of polyamines, and in that (i) and (ii) are reacted in a molar ratio in the range of 1.4:1 to 1:1 ((i):(ii)).

In a second aspect, the invention provides the additive as defined under the first aspect.

In a third aspect, the invention provides the use of the additive of the second aspect as a detergent and/or lubricity improver in a fuel oil.

When used in a fuel oil, and especially a middle distillate fuel oil, the additive according to the invention provides surprisingly-improved fuel detergency, especially in fuel oil systems such as diesel fuel engines where improved fuel injector detergency is observed. In addition, the additive can provide lubricity improvement for fuel oils, a property of increasing usefulness especially in middle distillate fuels as incremental legislative changes force down the level of sulphur of such fuels, leading to fuel processing and compositional changes which reduce the fuels' inherent lubricity properties. Such lubricity enhancement is particularly effective in inhibiting wear in the fuel injection pumps of diesel engine systems which, due to engineering developments aimed at reducing emissions, are being designed to operate at increasingly high pressures and are therefore more prone to wear These improvements in performance are believed to result from the optimised structure of the product defined under the first aspect of the invention Without being bound to any particular theory, it is thought that the combination in the product of a polyalkylene polyamine having a high proportion of heavy (i.e. higher molecular weight) components, and a relatively low average molar ratio of acylating agent (i) to polyamine (ii), gives rise to products having a balance of polar and non-polar groups which is particularly effective in the fuel oil environment.

The First Aspect of the Invention

The Product

The product is preferably obtained by the reaction of (i) and (Ii) as above defined.

(i) The Hydrocarbyl-Substituted Succinic Acylating Agent

The term hydrocarbyl denotes a group having a carbon atom directly attached to the remainder of the molecule and which has a predominantly aliphatic hydrocarbon character. Therefore, hydrocarbyl substituents can contain up to one non-hydrocarbyl group for every 10 carbon atoms provided that this non-hydrocarbyl group does not significantly alter the predominantly aliphatic hydrocarbon character of the group. Those skilled in the art will be aware of such groups, which include, for example, hydroxyl, halo (especially chloro and fluoro), alkoxyl, alkyl mercapto, alkyl sulfoxy, etc. Usually, however, the hydrocarbyl substituents are purely aliphatic hydrocarbon in character and do not contain such groups.

The hydrocarbyl substituents are predominantly saturated. The hydrocarbyl substituents are also predominantly aliphatic in nature, that is, they contain no more than one non-aliphatic moiety (cycloalkyl, cycloalkenyl or aromatic) group of 6 or less carbon atoms for every 10 carbon atoms in the substituent. Usually, however, the substituents contain no more than one such non-aliphatic group for every 50 carbon atoms, and in many cases, they contain no such non-aliphatic groups at all; that is, the typically substituents are purely aliphatic. Typically, these purely aliphatic substituents are alkyl or alkenyl groups.

The hydrocarbyl substituents preferably average at least 30 to 50 and up to about 100 carbon atoms, corresponding to an Mn of approximately 400 to 1500 such as 550 to 1500, and preferably 700 to 1500. An Mn of 700 to 1300 is preferred.

Specific examples of the predominantly saturated hydrocarbyl substituents containing an average of more than 30 carbon atoms are the following: a mixture of poly(ethylene/propylene) or poly(ethylene/butene) groups of about 35 to about 70 carbon atoms: a mixture of poly(propylene/1-hexene) groups of about 80 to about 100 carbon atoms: a mixture of poly(isobutene) groups having an average of 50 to 75 carbon atoms; a mixture of poly (1-butene) groups having an average of 50–75 carbon atoms.

A preferred source of the substituents are poly(isobutene)s, for examples those obtained by polymerization of a C4 refinery stream having a butene content of 35 to 75 weight percent and isobutene content of 30 to 60 weight percent in the presence of a Lewis acid catalyst such as aluminium trichloride or boron trifluoride. These polybutenes predominantly contain isobutene monomer repeating units of the configuration $$—C(CH_3)_2CH_2—$$

The hydrocarbyl substituent is attached to the succinic acid moiety or derivative thereof via conventional means, for example the reaction between maleic anhydride and an unsaturated substituent precursor such as a polyalkene, as described for example in EP-B-0 451 380.

One procedure for preparing the substituted succinic acylating agents involves first chlorinating the polyalkene until there is an average of at least about one chloro group for each molecule of polyalkene. Chlorination involves merely contacting the polyalkene with chlorine gas until the desired amount of chlorine is incorporated into the chlorinated polyalkene. Chlorination is generally carried out at a temperature of about 75° C. to about 125° C. If desired, a diluent can be used in the chlorination procedure. Suitable diluents for this purpose include poly- and perchlorinated and/or fluorinated alkanes and benzenes.

The second step in the procedure is to react the chlorinated polyalkene with the maleic reactant at a temperature usually within the range of about 100° C. to about 200° C. The mole ratio of chlorinated polyalkene to maleic reactant is usually about 1:1. However, a stoichiometric excess of maleic reactant can be used, for example, a mole ratio of 1:2 If an average of more than about one chloro group per molecule of polyalkene is introduced during the chlorination step, then more than one mole of maleic reactant can react per molecule of chlorinated polyalkene. It is normally desirable to provide an excess of maleic reactant; for example, an excess of about 5% to about 25% by weight. Unreacted excess maleic reactant may be stripped from the reaction product, usually under vacuum.

Another procedure for preparing substituted succinic acid acylating agents utilises a process described in U.S. Pat. No. 3,912,764 and U.K. Pat. No. 1,440,219. According to that process, the polyalkene and the maleic reactant are first reacted by heating them together in a direct alkylation procedure. When the direct alkylation step is completed, chlorine is introduced into the reaction mixture to promote reaction of the remaining unreacted maleic reactants. According to the patents, 0.3 to 2 or more moles of maleic anhydride are used in the reaction for each mole of polyalkene. The direct alkylation step is conducted at temperatures to 18° C. to 250° C. During the chlorine-introducing stage, a temperature of 160° C. to 225° C. is employed.

Other known processes for preparing the substituted succinic acylating agents include the one-step process described in U.S. Pat. Nos. 3,215,707 and 3,231,587. Basically, this process involves preparing a mixture of the polyalkene and the maleic reactant in suitable proportions and introducing chlorine into the mixture, usually by passing chlorine gas through the mixture with agitation, while maintaining a temperature of at least about 140° C.

Usually, where the polyalkene is sufficiently fluid at 140° C. and above, there is no need to utilise an additional substantially inert, normally liquid solvent/diluent in the one-step process. However, if a solvent/diluent is employed, it is preferably one that resists chlorination such as the poly- and per-chlorinated and/or -fluorinated alkanes, cycloalkanes, and benzenes.

Chlorine may be introduced continuously or intermittently during the one-step process. The rate of introduction of the chlorine is not critical although, for maximum utilisation of the chlorine, the rate should be about the same as the rate of consumption of chlorine in the course of the reaction. When the introduction rate of chlorine exceeds the rate of consumption, chlorine is evolved from the reaction mixture. It is often advantageous to use a closed system, including superatmospheric pressure, in order to prevent loss of chlorine so as to maximize chlorine utilisation.

The minimum temperature at which the reaction in the one-step process takes place at a reasonable rate is about 140° C. Thus, the minimum temperature at which the process is normally carried out is in the neighbourhood of 140° C. The preferred temperature range is usually between about 160° C. and about 220° C. Higher temperatures such as 250° C. or even higher may be used but usually with little advantage. In fact, excessively high temperatures may be disadvantageous because of the possibility that thermal degradation of either or both of the reactants may occur at excessively high temperatures.

In the one-step process, the molar ratio of maleic reactant to chlorine is such that there is at least about one mole of chlorine for each mole of maleic reactant to be incorporated into the product. Moreover, for practical reasons, a slight excess, usually in the neighbourhood of about 5% to about 30% by weight of chlorine is utilised in order to offset any loss of chlorine from the reaction mixture. Larger amounts of excess chlorine may be used.

The attachment of the hydrocarbyl substituent to the succinic moiety may alternatively be achieved via the thermally-driven 'ene' reaction, in the absence of chlorine. Use of such a material is the acylating agent (i) leads to products having particular advantages; for example, chlorine-free products having excellent detergency and lubricity properties. In such products, the reactant (i) is preferably formed from a polyalkene having at least 30% preferably 50% or more such as 75% of residual unsaturation in the form of terminal, e.g. vinylidene, double bonds.

(ii) The Polyalkylene Polyamine

The polyamines suitable in this invention are those comprising amino nitrogens linked by alkylene bridges, which amino nitrogens may be primary, secondary and/or tertiary in nature. The polyamines may be straight chain, wherein all the amino groups will be primary or secondary groups, or may contain cyclic or branched regions or both, in which case tertiary amino groups may also be present. The alkylene groups are preferably ethylene or propylene groups, with ethylene being preferred. Such materials may be prepared from the polymerisation of lower alkylene diamines such as ethylene diamine, a mixture of polyamines being obtained, or via the reaction of dichloroethane and ammonia.

The present invention has discovered that the nature of the polyamine, and in particular the relative proportions of different polyamines within a polyamine mixture, has an important bearing on the performance of the product defined under the invention. It is preferred that where the polyamine component (ii) is a mixture, the mixture contains at least 70%, and preferably at least 75% by weight, of polyamines having seven or more nitrogen atoms per molecule, based on the total weight of polyamines Preferably, the mixture comprises polyamines having seven and eight, and optionally nine, nitrogen atoms per molecule.

More preferably, the polyamine mixture comprises at least 45% and preferably 50% by weight of polyamines having seven nitrogen atoms per molecule, based on the total weight of polyamines.

The polyamine component (ii) may be defined by the average number of nitrogen atoms per molecule of the component (ii), which is preferably in the range of 6.5 to 8.5, more preferably 6.8 to 8, especially 6.8 to 7.5 nitrogens per molecule. The number of nitrogens appears to influence the ability of the product to provide fuel oil detergency and lubricity enhancement, especially in middle distillate fuel oils such as diesel fuel where good injector detergency is exhibited in both 'keep clean' and 'clean-up' tests The reaction of polyamine (ii) with the acylating agent (i) is carried out in the appropriate ratio, as above defined.

Preferably, the molar ratio of (i):(ii) is in the range of 1.35:1 to 1.05:1, more preferably 1.3:1 to 1.151, and most preferably 1.25:1 to 1.15:1. For this purpose, the molar quantity of (i) refers to the molar quantity of pibsa formed during the reaction procedure as previously described, and does not typically refer to the total molar quantity of pib found in the pibsa reactant (i) which may be higher if unreacted pib remains from the pibsa formation reaction. The molar quantity of pibsa is typically determined by titration, e.g. via saponification of the reacted maleic anhydride moieties. The specific mixture of individual reaction products obtained by operating within such ratios has been found to be particularly useful for fuel oil applications, especially middle distillate fuel oil applications.

The reaction is typically carried out at conventional temperatures in the range of about 80° C. to about 200° C., more preferably about 140° C. to about 180° C. These reactions may be conducted in the presence or absence of an ancillary diluent or liquid reaction medium, such as a mineral oil or aromatic solvent. If the reaction is conducted in the absence of an ancillary solvent of this type, such is usually added to the reaction product on completion of the reaction. In this way the final product is in the form of a convenient solution and thus is compatible with an oil. Suitable solvent oils are oils used as a lubricating oil basestock, and these generally include lubricating oils having a viscosity (ASTM D 445) of 2 to 40, preferably 3 to 12 $mm^2$/sec at 100° C., with the primarily paraffinic mineral oils, such as those in the range of Solvent 90 to Solvent 150 Neutral, being preferred.

More preferred are aromatic solvents which give rise to particularly low viscosity products and result in products having surprisingly advantageous compatibility when blended with other components in the additive. Advantageous solvents include xylenes, trimethylbenzene, ethyl toluene, diethylbenzene, cymenes, amylbenzene, diisopropyl benzene, or mixtures thereof, optionally with isoparaffins. Products obtained via reaction in such solvents can be blended to form particularly homogeneous additives containing other additive components.

The Additive

The additives of the invention may be used singly or as mixtures. They may contain one or more co-additives such as known in the art, for example the following: detergents, antioxidants, corrosion inhibitors, dehazers, demulsifiers, metal deactivators, antifoaming agents, cetane improvers, cosolvents, package compatibilisers, lubricity additives, antistatic additives and cold flow additives.

Concentrates comprising the additive in admixture with a carrier liquid (e.g. as a solution or a dispersion) are convenient as a means for incorporating the additive into bulk oil such as distillate fuel, which incorporation may be done by methods known in the art. The concentrates may also contain other additives as required and preferably contain from 3 to 75 wt %, more preferably 3 to 60 wt %, most preferably 10 to 50 wt % of the additives preferably in solution Examples of carrier liquid are organic solvents including hydrocarbon solvents, for example petroleum fractions such as naphtha, kerosene diesel and heater oil; aromatic hydrocarbons such as aromatic fractions, e.g. those sold under the 'SOLVESSO' tradename; alcohols, ethers and other oxygenates and paraffinic hydrocarbons such as hexane and pentane and isoparaffins. The carrier liquid must, of course, be selected having regard to its compatibility with the additive and with the fuel The additives of the invention may be incorporated into fuel oil by other methods such as those known in the art. If co-additives are required, they may be incorporated into the fuel oil at the same time as the additives of the invention or at a different time.

The Fuel Oil

The fuel oil may be a hydrocarbon fuel such as a petroleum-based fuel oil for example gasoline, kerosene or distillate fuel oil, suitably a middle distillate fuel oil, i.e. a fuel oil obtained in refining crude oil as the fraction between the lighter kerosene and jet fuels fraction and the heavier fuel oil fraction. Such distillate fuel oils generally boil within the range of about 100° C. to about 500° C., e.g. 150° to about 400° C., for example, those having a relatively high Final Boiling Point of above 360° C. (ASTM D-86). Middle distillates contain a spread of hydrocarbons boiling over a temperature range, including n-alkanes which precipitate as wax as the fuel cools. They may be characterised by the temperatures at which various %'s of fuel have vaporised, e.g. 10% to 90%, being the interim temperatures at which a certain volume % of initial fuel has distilled. The difference between say 90% and 20% distillation temperature may be significant. They are also characterised by pour, cloud and CFPP points, as well as their initial boiling point (IBP) and final boiling point (FBP). The fuel oil can comprise atmospheric distillate or vacuum distillate, or cracked gas oil or a blend in any proportion of straight run and thermally and/or catalytically cracked distillates. The most common petroleum distillate fuels are kerosene, jet fuels, diesel fuels, heating oils and heavy fuel oils. The heating oil or diesel fuel may be a straight atmospheric distillate, or it may contain minor amounts, e.g. up to 35 wt %, of vacuum gas oil or cracked gas oils or of both.

Heating oils may be made of a blend of virgin distillate, e.g. gas oil, naphtha, etc and cracked distillates, e.g. catalytic cycle shock. A representative specification for a diesel fuel includes a minimum flash point of 38° C. and a 90% distillation point between 282 and 380° C. (see ASTM Designations D-396 and D-975).

The fuel oil may also contain other additives such as stabilisers, dispersants, antioxidants, corrosion inhibitors and/or demulsifiers.

The fuel oil may have a sulphur concentration of 0.2% by weight or less based on the weight of the fuel. Preferably, the sulphur concentration is 0.05% by weight or less, such as 0.035% by weight or less, more preferably 0.01% by weight or less. The art describes methods for reducing the sulphur concentration of hydrocarbon middle distillate fuels, such methods including solvent extraction, sulphuric acid treatment, and hydrodesulphurisation. The additive of the invention is particularly advantageous in the fuels having low sulphur contents, providing excellent lubricity improvement and good detergency.

Also, the fuel oil may be an animal or vegetable oil, or a mineral oil as described above in combination with an animal or vegetable oil.

Biofuels, i.e. fuels from animal or vegetable sources, are obtained from a renewable source. It has been reported that on combustion less carbon dioxide is formed than is formed by the equivalent quantity of petroleum distillate fuel, e.g. diesel fuel, and very little sulphur dioxide is formed. Certain derivatives of vegetable oil, for example rapeseed oil, e.g. those obtained by saponification and re-esterification with a monohydric alcohol, may be used as a substitute for diesel fuel. It has been reported that mixtures of a rapeseed ester, for example, rapeseed methyl ester (RME), with petroleum distillate fuels in ratios of, for example, 10:90 by volume are commercially available.

Thus, a biofuel is a vegetable or animal oil or both or a derivative thereof.

Vegetable oils are mainly triglycerides of monocarboxylic acids, e.g. acids containing 10–25 carbon atoms and listed below

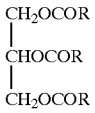

where P is an aliphatic radical of 10–25 carbon atoms which may be saturated or unsaturated.

Generally, such oils contain glycerides of a number of acids, the number and kind varying with the source vegetable of the oil.

Examples of oils are rapeseed oil, tall oil, coriander oil, soyabean oil, cottonseed oil, sunflower oil, castor oil, olive oil, peanut oil, maize oil, almond oil, palm kernel oil, coconut oil, mustard seed oil, beef tallow and fish oils. Rapeseed oil, which is a mixture of fatty acids esterified with glycerol, is preferred as it is available in large quantities and can be obtained in a simple way by pressing from rapeseed.

Examples of derivatives thereof are alkyl esters, such as methyl esters, of fatty acids of the vegetable or animal oils. Such esters can be made by transesterification.

As lower alkyl esters of fatty acids, consideration may be given to the following, for example as commercial mixtures: the ethyl, propyl, butyl and especially methyl esters of fatty acids with 12 to 22 carbon atoms, for example of lauric acid, myristic acid, palmitic acid, palmitoleic acid, stearic acid, oleic acid, elaidic acid, petroselic acid, ricinoleic acid, elaeostearic acid, linoleic acid, linolenic acid, eicosanoic acid, gadoleic acid, docosanoic acid or erucic acid, which have an iodine number from 50 to 210, especially 90 to 180. Mixtures with particularly advantageous properties are those which contain mainly, i.e. to at least 50 wt % methyl esters of fatty acids with 16 to 22 carbon atoms and may contain 1, 2 or 3 double bonds. The preferred lower alkyl esters of fatty acids are the methyl esters of oleic acid, linoleic acid, linolenic acid and erucic acid.

Commercial mixtures of the stated kind are obtained for example by cleavage and esterification of natural fats and oils by their transesterification with lower aliphatic alcohols. For production of lower alkyl esters of fatty acids it is advantageous to start from fats and oils with high iodine number, such as, for example, sunflower oil, rapeseed oil, coriander oil, castor oil, soyabean oil, cottonseed oil, peanut oil or beef tallow. Lower alkyl esters of fatty acids based on a new variety of rapeseed oil, the fatty acid component of which is derived to more than 80 wt % from unsaturated fatty acids with 18 carbon atoms, are preferred.

The concentration of the additive in the fuel oil may for example be in the range of 1 to 5,000 ppm of additive (active ingredient) by weight per weight of fuel, for example 5 to 5,000 ppm such as 5 to 2000 ppm (active ingredient) by weight per weight of fuel, preferably 10 to 500 ppm, more preferably 10 to 200 ppm.

EXAMPLE 1

Additive A

A 60% active ingredient solution (in aromatic solvent) of a PIBSA-PAM product obtained from the condensation reaction of a chlorinated PIBSA (succinic anhydride) derived from polyisobutene of Mn approx. 950 with a polyethylene polyamine mixture containing approximately 84% by weight of polyamines containing more than six nitrogen atoms, and predominating in seven and eight nitrogen molecules, in a molar ratio of 1.2:1 (PIBSA PAM). The synthesis was carried out as follows:

The PIBSA (750 g) and $C_9$ aromatic Solvent (469.7 g) were introduced into a reaction flask equipped with a nitrogen sparge. The mixture was heated to 155° C. PAM (159.5 g) was added dropwise over 1 hour keeping the temperature around 165° C. After complete addition, the temperature was set to 165° C. and the mixture left to soak for about 5 hours (or until no more water was collected). The nitrogen sparge rate was increased towards the end of the reaction when the rate of water collection fell to a very low rate.

Comparative Additive

A PIBSA-PAM product obtained from equivalent conditions with the same PIBSA, but using a molar ratio of 1.8:1 (PIBSA:PAM) and a polyethylene polyamine mixture of average composition approximating to pentaethylenehexamine and comprising approximately 33.5% by weight of polyamines having more than six nitrogen atoms per molecule, based on the total weight of polyamines. The solvent was mineral oil (Solvent Neutral 150) having a kinematic viscosity of 28.8–31.9 cst at 40° C., the active ingredient level of the product being approx 50% wt.

The diesel fuel detergency properties of Additive A and the Comparative Additive were tested using a test engine protocol (the 'Cummins L10') which provides an assessment of the degree of injector deposits resulting from engine operation on a reference fuel. The injector deposits can be measured by a rating of the deposit on each fuel injector according to a 'demerits' scale and also by measurement of the mean air flow through a given set of fuel injectors before and after the test, the percentage loss in air flow due to deposit build-up during the test being recorded.

FIG. 1 illustrates the results of various tests conducted in a low sulphur reference diesel fuel.

| TEST | METHOD | RESULTS ° C. |
|---|---|---|
| Distillation-IBP | ASTM D86 | 196 |
| 5% | | 214 |
| 10% | | 221 |
| 20% | | 232 |
| 30% | | 242 |
| 40% | | 253 |
| 50% | | 264 |
| 60% | | 276 |
| 70% | | 288 |
| 80% | | 301 |
| 90% | | 317 |
| 95% | | 328 |
| Distillation-EP | 339 | |
| Gravity | ASTM D4052 | 34.3 |
| Pour Point | ASTM D97 | −21° C. |
| Cloud Point | ASTM D2500 | −20+ C. |
| Flash Point | ASTM D93 | 81 |
| Viscosity, 40° C. | ASTM D445 | 2.7 |
| Sulfur | ASTM D4294 | 0.034 |
| Aromatics by SFC | D5186 | 29.6 |
| | ASTM D1796 | <0.05 |
| Ramsbottom carbon, 10% resid | ASTM D524 | 0.12 |
| Ash content | ASTM D482 | 0.002 |
| Acid Number | ASTM D664 | <0.05 |
| Copper Corrosion | ASTM D130 | 113 |
| Cetane Number | ASTM D613 | 46.5 |
| Cetane Index | ASTM D976 | 45.6 |
| Cetane Index | ASTM D4737 | 45.3 |

It can be seen that the treat curve for Additive A provides acceptable demerits (less than 10) at approximately 50 ppm, whereas the Comparative Additive fails to reach acceptable demerits at a treat rate well in excess of 100 ppm, showing the improved efficacy of the additive to the invention.

What is claimed is:

1. A fuel oil composition comprising a fuel oil having 0.2 wt.% or less sulfur and 1 to 5,000 ppm of an additive, wherein the additive comprises the product obtainable by the reaction between:

(i) a hydrocarbyl-substituted succinic acylating agent, wherein the hydrocarbyl substituent has a number-average molecular weight (Mn) of 250 to 2500, and (ii) one or more polyalkylene polyamines, characterised in that the polyamine component (ii) contains greater than 35% by weight of polyamines having more than six nitrogen atoms per molecule, based on the total weight of polyamines, and in that (i) and (ii) are reacted in a molar ratio in the range of 1.4:1 to 1:1 ((i):(ii)).

2. The composition of claim 1, wherein the polyamine component (ii) is a mixture of polyamines and wherein the mixture contains at least 70% by weight of polyamines having seven or more nitrogen atoms per molecule, based on the total weight of polyamines.

3. The composition of claim 1 or claim 2, wherein the polyamine component (ii) is a mixture comprising polyamines having seven and eight, and optionally nine, nitrogen atoms per molecule.

4. The composition of claim 1 or claim 2 wherein the polyamine component (ii) is a mixture comprising at least 45% by weight of polyamines having seven nitrogen atoms per molecule, based on the total weight of polyamines.

5. The composition of claim 1 or claim 2 wherein the average number of nitrogen atoms per molecule of the polyamine component (ii) is in the range of 6.5 to 8.5 nitrogens.

6. The composition of claim 5, wherein the average number of nitrogen atoms per molecule is in the range of 6.8 to 8 nitrogens.

7. The composition of claim 1 or claim 2 wherein the molar ratio of (i):(ii) is in the range of 1.3:1 to 1.15:1.

8. The composition of claim 1 or claim 2 wherein the fuel oil is a middle distillate fuel oil.

* * * * *